United States Patent [19]

Mattei et al.

[11] Patent Number: 4,655,871

[45] Date of Patent: Apr. 7, 1987

[54] DEVICE FOR FEEDING REVENUE STAMPS ON A CIGARETTE PACKING MACHINE

[75] Inventors: Riccardo Mattei; Alessandro Minarelli, both of Bologna, Italy

[73] Assignee: G.D Societa' per Azioni, Bologna, Italy

[21] Appl. No.: 872,206

[22] Filed: Jun. 9, 1986

[30] Foreign Application Priority Data

Jun. 14, 1985 [IT] Italy ..... 3465 A/85

[51] Int. Cl.[4] ..... B65C 1/06

[52] U.S. Cl. ..... 156/484; 156/389; 156/568

[58] Field of Search ..... 156/566–568, 156/572, 751, 482–484, 212, 215, 476, 479, 485–486, 389

[56] References Cited

U.S. PATENT DOCUMENTS 1,991,225 2/1985 Oslund ..... 156/571 X
3,152,943 12/1964 Eddison et al. ..... 156/483
3,201,299 8/1965 Fairest ..... 156/485
4,564,412 1/1986 Oberdorf ..... 156/484

FOREIGN PATENT DOCUMENTS 1101442 10/1955 France .

*Primary Examiner*—David Simmons
*Attorney, Agent, or Firm*—Marshall, O'Toole, Gerstein, Murray & Bicknell

[57] ABSTRACT

A device for feeding revenue stamps on a cigarette packing machine, whereby each packet coming off a wrapping unit is fed along an unloading route extending through a fork grip; between two arms of which grip there is stretched a revenue stamp withdrawn by the grip from a respective pocket integral with the periphery of a roller having its axis perpendicular to the unloading route and tangent with a conveyor roller having its axis parallel with the unloading route and having projections, each of which projections is designed to retain a revenue stamp and to feed it into a respective pocket along a route tangent with a gumming roller.

7 Claims, 1 Drawing Figure

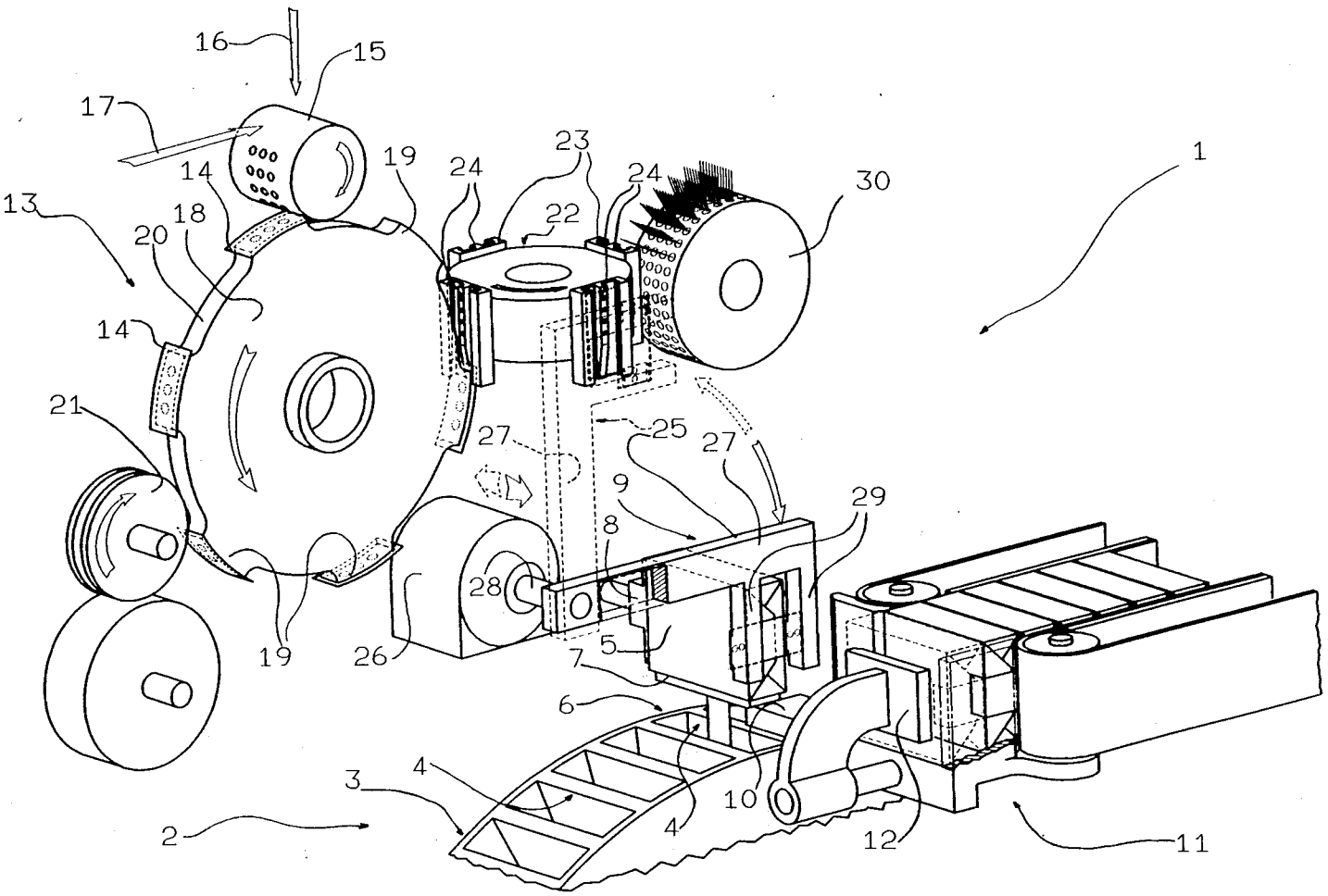
1
2
3
4
4
5
6
7
8
9
10
11
12
13
14
14
15
16
17
18
19
19
20
21
22
23
24
24
25
26
27
27
28
29
30

DEVICE FOR FEEDING REVENUE STAMPS ON A CIGARETTE PACKING MACHINE

BACKGROUND OF THE INVENTION

The present invention relates to a device for feeding revenue stamps on a cigarette packing machine.

On cigarette packing machines, revenue stamps are usually affixed to the finished packets coming off a wrapping wheel, which stamps are either withdrawn, by means of a feeding device, from the bottom of a stack, or cut successively off a continuous strip.

On known feeding devices, each revenue stamp is picked up by a roller and fed by the same to the top of a vertical guide defined by a number of pairs of parallel rollers. As it moves down the said guide, each stamp is gummed on one side, by means of gumming devices, and then fed axially into a pocket having a lateral withdrawal opening on the gumfree side of the stamp. Each stamp is held by suction inside the said pocket and withdrawn from the same, through the said lateral opening, by means of a fork grip. The said grip comprises arms having suction means for cooperating with the gumfree side of the stamp housed inside the said pocket, and designed to travel parallel with the axis of the said lateral opening, for extracting the stamp from the said pocket and transferring it, via rotation of the said fork about an axis parallel with the axis of the said lateral opening, to an affixing location along the route travelled by the finished packets coming off the said wrapping wheel.

At the said affixing location, each packet coming off the said wrapping wheel travels through the arms on the said fork grip and, cooperating with the gummed side of the stamp stretched between the arms on the grip, causes the stamp to be ripped off the arms and affixed to one end of the packet.

One of the major drawbacks on known revenue stamp feeding devices of the aforementioned type is that, as they travel down the said roller guide, the stamps tend to slide laterally into a skew position. Consequently, in addition to the receiving pocket at the bottom end of the roller guide having to be designed wider than the stamp, for preventing possible jamming, the stamp may be fed crookedly into the pocket, thus resulting in it being withdrawn, not perfectly straight, by the fork grip, and affixed crookedly onto the packet.

A further drawback on known feeding devices of the aforementioned type is that the gumming devices are located along the said roller guide, i.e. over the receiving pocket. Consequently, any gum dripping from the gumming devices falls straight onto the receiving pocket, which must therefore be cleaned frequently for preventing the stamps from sticking to the pocket and thus stopping the machine.

SUMMARY OF THE INVENTION

The aim of the present invention is to provide a revenue stamp feeding device involving none of the aforementioned drawbacks.

With this aim in view, according to the present invention, there is provided a device for feeding revenue stamps on a cigarette packing machine, whereby each packet coming off a wrapping unit is fed along a given unloading route, characterised by the fact that it comprises means for feeding the said stamps successively and in step-by-step manner along a given supply route; gumming means located along the said supply route; an output roller mounted for step-by-step rotation about an axis perpendicular to the said unloading route, the said output roller presenting a number of peripheral pockets, each designed to move, together with the said output roller, between a loading position, wherein the said supply route extends through the said pocket, and an unloading position, wherein the said pocket is arranged perpendicular to the said unloading route; and a stamp withdrawal member designed to move between a withdrawal position, facing one of the said pockets, and a release position, substantially on the said unloading route.

BRIEF DESCRIPTION OF THE DRAWING

The present invention will be described by way of example with reference to the attached drawing showing a schematic view of a preferred embodiment of the same.

DETAILED DESCRIPTION OF THE INVENTION

Number 1 on the attached drawing indicates a cigarette packing machine comprising a wrapping unit 2, an output roller 3 of which is mounted for rotation about a horizontal axis and provided with a number of seats 4 around its outer periphery. Each seat 4 is designed to receive a respective packet of cigarettes 5, and to feed it to an output station 6 where each packet 5 is thrust radially outwards and upwards by a pusher 7 moving back and forth through the seat 4 facing it.

When supported outside wheel 3 by pusher 7, each packet 5 is engaged laterally by a pusher 8 moving back and forth along a horizontal axis parallel with the rotation axis of wheel 3, and is fed by pusher 8 along a horizontal unloading route 9, parallel with the rotation axis of wheel 3, up to a supporting plate 10 located at the input of an output conveyor 11. Packets 5 are then fed successively onto conveyor 11 by means of a further pusher 12 moving back and forth along a horizontal axis perpendicular to the operating axis of pusher 8 and aligned with the axis of conveyor 11.

Over wheel 3, there is provided a device 13 for feeding revenue stamps 14, said device comprising a known type of suction input roller 15 designed to receive stamps 14 from the bottom of a feedbox (not shown) in the direction of arrow 16, or from off the end of a supply strip (not shown) in the direction of arrow 17.

Suction roller 15 is located over supply means consisting of a conveyor roller 18 having a number of radial projections or appendixes 19, each separated from the adjacent appendix 19 by a dip 20. Each appendix 19 is designed to travel in step-by-step manner along a circular supply route tangent with roller 15, from which each appendix 19 sucks off a respective stamp 14, with gumming means comprising a gumming roller 21 designed to coat one side of stamp 14 with gum, and with an output conveyor roller 22 located substantially over pusher 7.

Output roller 22 is mounted for rotation about a vertical axis perpendicular to the rotation axis of wheel 3 and to unloading route 9, and presents a number of peripheral pockets 23 arranged parallel with the rotation axis of output roller 22 and presenting, when sectioned perpendicular to the axis of output roller 22, a substantially U-shaped section with its concave side facing outwards. Each pocket 23 presents a centre axial rib 24, and is shorter than the length of dips 20 and shallower than the height of appendixes 19 above adjacent dips 20.

Each pocket 23 is moved forward in step-by-step manner by output roller 22 into a first loading position, wherein the said pocket 23 is arranged facing a respective dip 20 on conveyor roller 18. One forward step of the said conveyor 18 causes an appendix 19 to engage the said pocket 23 axially, and to deposit inside the same, by means of suction through rib 24, a respective stamp 14 arranged with its gummed side facing rib 24 and its gumfree side facing outwards.

After receiving respective stamp 14, the said pocket 23 is held by output roller 22 in the said loading position, until conveyor roller 18, moving forward one step, brings the next dip 20 into position facing pocket 23. At this point, output roller 22 moves forward one step, to bring pocket 23 from the said loading position facing the periphery of conveyor roller 18 into an unloading position wherein pocket 23 is arranged perpendicular to unloading route 9 and facing a withdrawal member consisting of fork grip 25.

By means of an actuating device 26, fork grip 25 is designed to move back and forth, along an axis over and parallel with route 9, between a withdrawal position, wherein grip 25 contacts pocket 23 containing stamp 14, and a back-up position into which grip 25 moves after sucking the said stamp 14 out of the said pocket 23. Fork grip 25 is substantially F-shaped, and comprises a supporting rod 27 connected at one end to a perpendicular rod 28 on actuator 26, and two parallel arms 29 perpendicular to rod 27 and having suction means not shown.

In the said withdrawal position, arms 29 are arranged crosswise in relation to the longitudinal axis of respective pocket 23 and of stamp 14 contained therein and usually rectangular in shape. Consequently, when withdrawn by fork grip 25, the said stamp 14 is arranged crosswise and stretched between the said arms 29.

Upon moving into the said back-up position, fork grip 25 is turned by actuating device 26 about the axis of rod 28 and into a lowered release position, wherein stamp 14 is arranged substantially horizontally over route 9, and arms 29 are arranged astride route 9 so as not to interfere with packet 5 fed along route 9 by pusher 8.

As it is fed along route 9 by pusher 8, each packet 5 passes through the gap formed by arms 29 on fork grip 25 in the said release position, the front end surface of the said packet 5 engaging the gummed surface of stamp 14 stretched between arms 29. At this point, the suction through arms 29 is cut off, and stamp 14 is folded so as to contact and adhere to the sides of packet 5.

Having yielded respective stamp 14 to fork grip 25, each pocket 23 is moved forward one step by output roller 22 so as to cooperate with cleaning means comprising a rotary brush 30 which brushes off any traces of gum left by stamp 14 on pocket 23.

As clearly dedicible from the foregoing description, the position of each stamp 14 is rigidly controlled throughout its transfer from roller 15 to the final position on output route 9, where it is affixed exactly as required onto packet 5. Furthermore, providing for conveyor roller 18 enables gumming roller 21 to be located relatively low down and definitely not over moving parts on packing machine 1.

Finally, by virtue of conveyor roller 18 and output roller 22 turning about axes perpendicular to each other, feeding device 13 may be located substantially coplanar with wrapping unit 2 and not, as is usually the case on packing machines employing known types of revenue stamp feeding devices, along a bed perpendicular to the plane of the wrapping unit, and in such a position as to greatly impede the freedom of movement of the operators.

We claim:

1. A device (13) for feeding revenue stamps (14) on a cigarette packing machine (1), whereby each packet (5) coming off a wrapping unit (2) is fed along a given unloading route (9), characterised by the fact that it comprises means (18) for feeding the said stamps (14) successively and in step-by-step manner along a given supply route; gumming means (21) located along the said supply route; an output roller (22) mounted for step-by-step rotation about an axis perpendicular to the said unloading route (9), the said output roller (22) presenting a number of peripheral pockets (23), each designed to move, together with the said output roller (22), between a loading position, wherein the said supply route extends through the said pocket (23), and an unloading position, wherein the said pocket (23) is arranged perpendicular to the said unloading route (9); and a stamp (14) withdrawal member (25) designed to move between a withdrawal position, facing one of the said pockets (23), and a release position, substantially on the said unloading route (9).

2. A device as claimed in claim 1, characterised by the fact that each said pocket (23) presents, when sectioned perpendicular to the rotation axis of the said output roller (22), a substantially U-shaped section with its concave side facing outwards.

3. A device as claimed in claim 2, characterised by the fact that the said supply means comprise a conveyor (18) having a number of projections (19) alternating with dips (20); each said projection (19) being designed to retain a respective said stamp (14), and engaging, in the said loading position, a respective said pocket (23).

4. A device as claimed in claim 3, characterised by the fact that each said dip (20) is longer than each said pocket (23), and dips, in relation to the said projections (19), by an amount greater than the depth of the said pockets (23).

5. A device as claimed in claim 1, characterised by the fact that the said supply means comprise a conveyor roller (18) mounted for rotation about an axis parallel with the said unloading route (9) and perpendicular to the rotation axis of the said output roller (22).

6. A device as claimed in claim 1, characterised by the fact that cleaning means (30) are provided for engaging each said pocket (23) downstream from the said unloading position and upstream from the said loading position in the rotation direction of the said output roller (22).

7. A device as claimed in claim 1, characterised by the fact that the said withdrawal member comprises a fork grip (25) having two parallel withdrawal arms (29) and mounted for rotation about an axis parallel with the said unloading route (9).

* * * * *